United States Patent [19]

Lin

[11] Patent Number: 4,834,278

[45] Date of Patent: May 30, 1989

[54] STRUCTURE OF DC MOTORIZED NAILING MACHINE

[76] Inventor: Chung-Cheng Lin, 2nd Fl., No. 7-2, Lane 27, Sec. 2, Chung Shan N. Rd., Taipei, Taiwan

[21] Appl. No.: 194,264

[22] Filed: May 16, 1988

[51] Int. Cl.[4] ..... B25C 5/15

[52] U.S. Cl. ..... 227/7; 227/131; 227/156

[58] Field of Search ..... 227/1, 131, 156

[56] References Cited

U.S. PATENT DOCUMENTS 4,573,625 4/1986 Olesen et al. ..... 227/131

4,720,033 9/1988 Olesen ..... 227/131

*Primary Examiner*—Paul A. Bell

*Attorney, Agent, or Firm*—Wenderoth, Lind & Ponack

[57] ABSTRACT

The principle of the present invention is to turn an electric power to a mechanical power and to make use of a mechanical mechanism to control the action of stapling and the opening of position switch with the arrangement of a thermo breaker and a LED to detect power source and to give alarm signal at time of shortage of power.

6 Claims, 8 Drawing Sheets

STRUCTURE OF DC MOTORIZED NAILING MACHINE

BACKGROUND OF THE INVENTION

The invention of stapler has renewed the binding technique to put the work from manual operation to a new era of machine binding procedure, which has also reduced the demand for man-power and improved working efficiency. Currently, the stapler has also been improving continuously from original manual operated stapler, foot driven stapler, pneumatic power stapler, to current motorized stapler, of which portable design is most appreciated. Such a stapling machine has now been widely used in carton box manufacturing field, packing industry, as well as in carpentry.

The stapling machines most popularly used in the market are of pneumatic power driven type, and the motorized stapling machines are less popularly used. The pneumatic power driven stapling machine is to be equipped with a heavy air compressor and should not be used far away from power source which supplys power for air compressor. Current motorized stapling machines adopt AC power and should be used within the range where power line attached there to can reach. Both said pneumatic power operated and motorized stapling machines are not portable and the utility of which are within the confines of the area where power source is available. Although there are portable stapling machines available now, the structure of which is still to be improved.

The main object of the present invention is to provide an improved DC motorized stapling machine, of which the mechanism is operated by means of a DC motor to drive a gear set, a ball screws and a gear wheel so as to compress and release the guide block and the spring by means of the posts of said gear wheel to complete the action of stapling.

Another object of the present invention is to provide an improved DC motorized stapling machine, of which the posts of the gear wheel are respectively for the control of two positions switches to keep the circuit ON during stapling.

The other object of the present invention is to provide an improved DC motorized stapling machine, of which the circuit is incorporated with position switches to form an automatic control loop and also connected with a thermo breaker and a LED to give alarm signal to the user to replace battery at time of shortage of power.

SUMMARY OF THE INVENTION

The present invention provides an improved structure of DC motorized stapling machine and more particularly a nailing machine to make use of battery power to drive a DC motor so as to turn round gear set, ball screws and gear wheel, letting spring and guide block start nailing: by means of position switches, thermo breaker and LED to automatically control the stapling action and to give an alarm signal to the user to replace the battery at time of shortage of power.

DETAILED DESCRIPTION OF THE PREFERRED EMBODIMENTS

Figure 1:
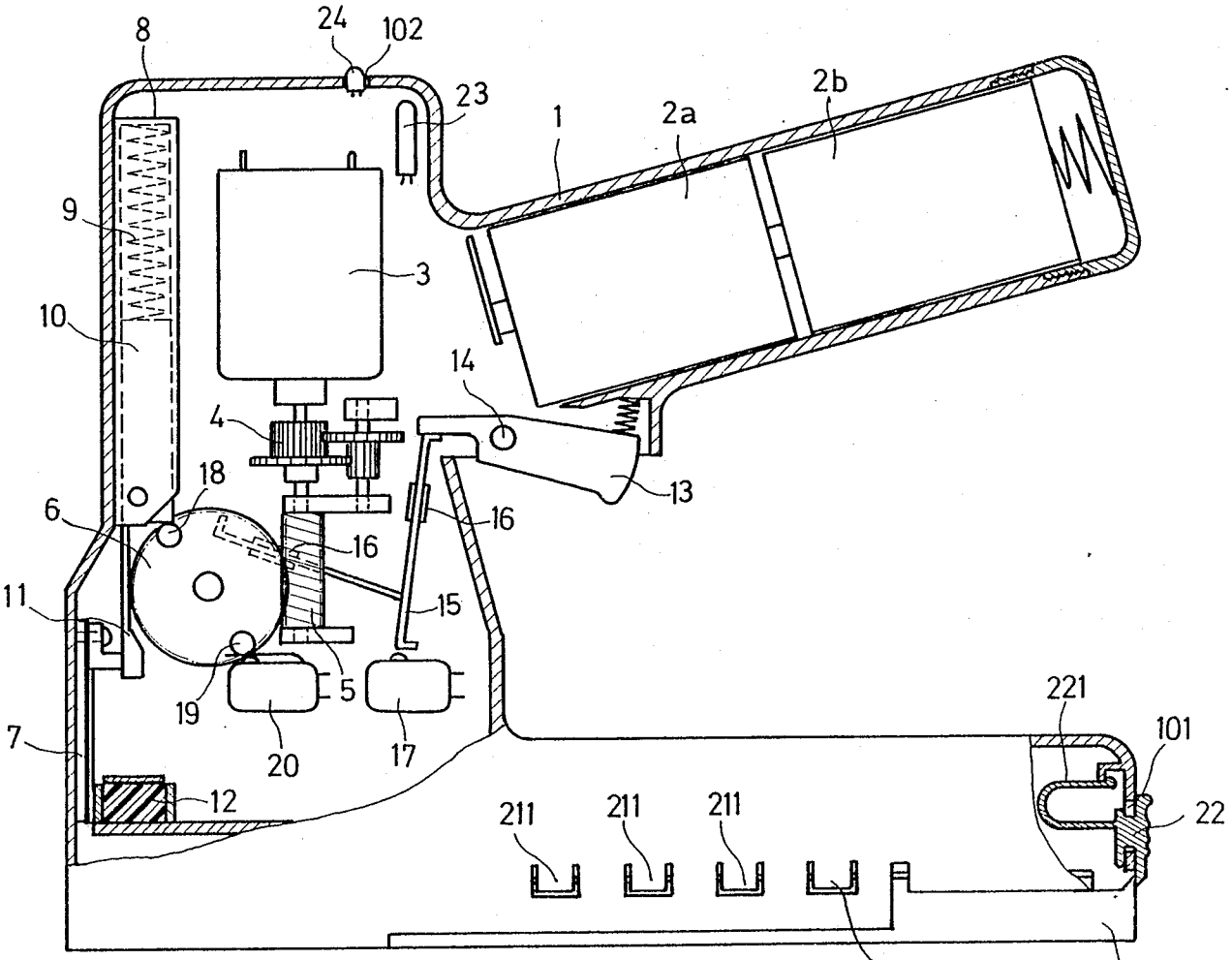
FIG. 1 is a partly cross sectional view of a DC motorized stapling machine embodying the present invention.

As shown in the sectional view of FIG. 1, two batteries *2a, 2b* are placed at the battery holder inside the handle of the machine body 1 to provide power supply. Said battery holder is connected with a DC motor 3 by means of an electric wire. Said DC motor is connected with a speed change gear 4 to drive a ball screws 5 which engages with a gear wheel 6. A guide channel 8 is arranged at one side of the percussion block 7 and a spring 9 and a guide block 10 are placed inside said guide channel 8. Said percussion block 7 and guide block 10 are connected together by a link rod 11 to make a synchronous movement. A shock absorbing rubber 12 is placed at the bottom to absorb the percussion force of the link rod 11. The power control button 13 is supported by the supporting rod 14. A "Y" shaped contact rod 15 is connected with the button 13 at the inner side of the machine body 1 and is firmly located where about by means of two holding grooves 16. A position switch 17 is arranged below said contact rod 15. Therefore, when the button 13 is pressed down the contact rod 15 turns on the position switch 17 to keep the circuit on so as to start the action of stapling. Two posts 18, 19 are respectively arranged at the gear wheel 6 at an angle of 180 to respectively support the guide block 10 and press on another position switch 20. The bottom of the machine body 1 is a staple cartridge portion 21 wherein several symmetric L-shaped frame rods are placed therein to facilitate the sliding of staple cartridge 21. When staple cartridge 21 is slipped to the end, it is then retained thereabout by a staple cartridge retainer 22 which is fixedly placed in the hole 101 and can be released by a spring 221. The motor 3 is connected with a thermo breaker 23 and a LED 24. Said LED is arranged inside the hole 101.

Figure 2:
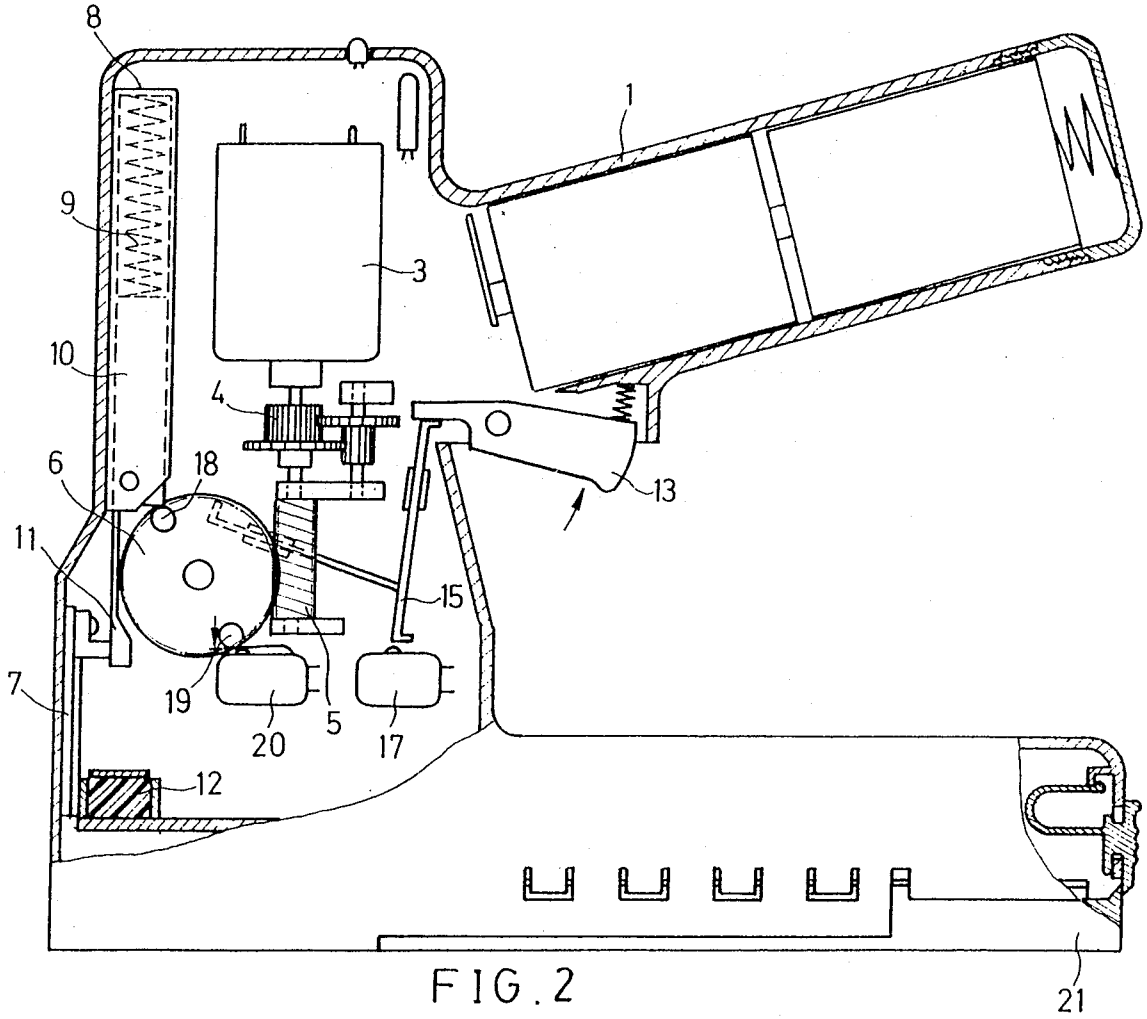
FIG. 2 illustrates an action of stapling 1 of a preferred embodiment according to the present invention.
Figure 3:
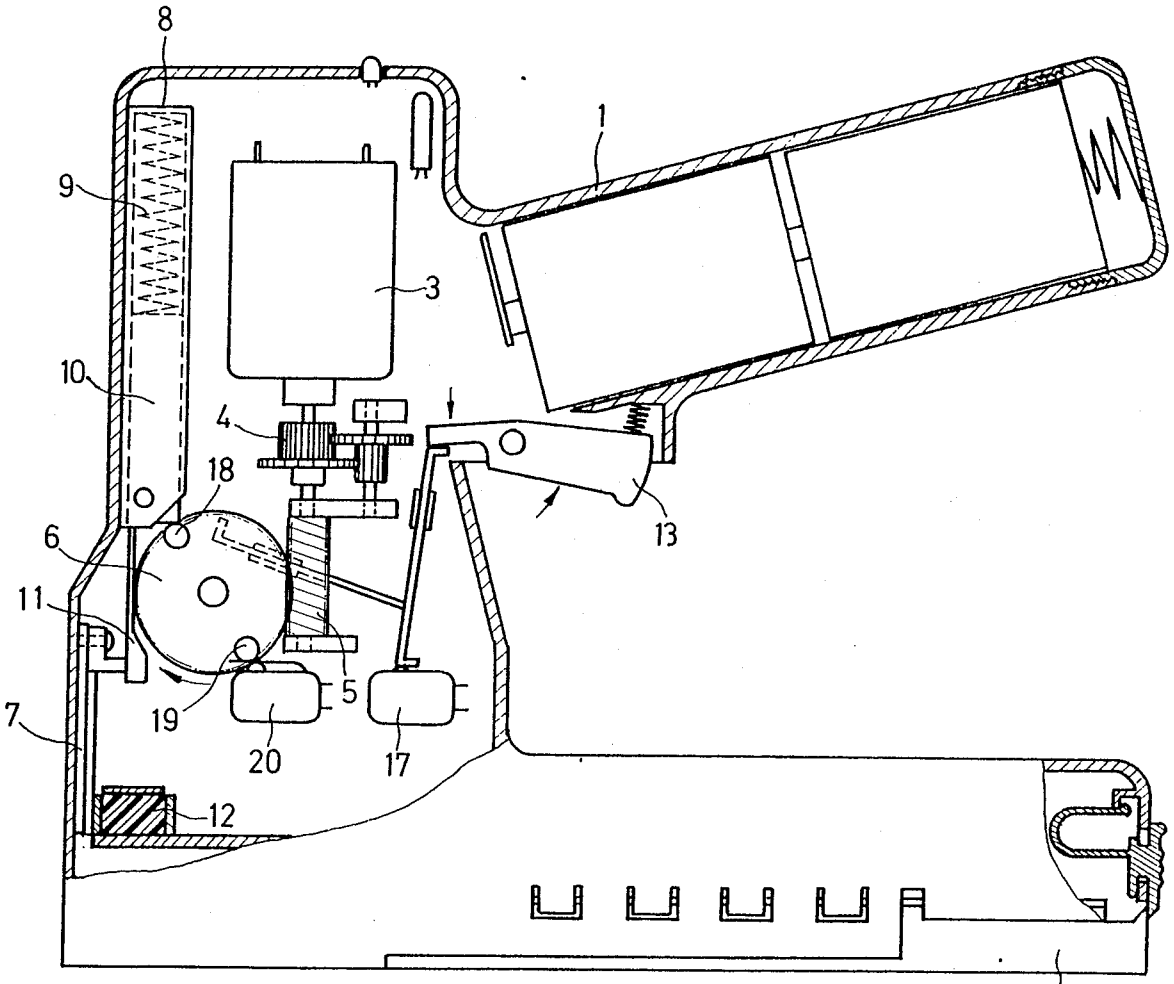
FIG. 3 illustrates another action of stapling 2 of the preferred embodiment according to the present invention.
Figure 4:
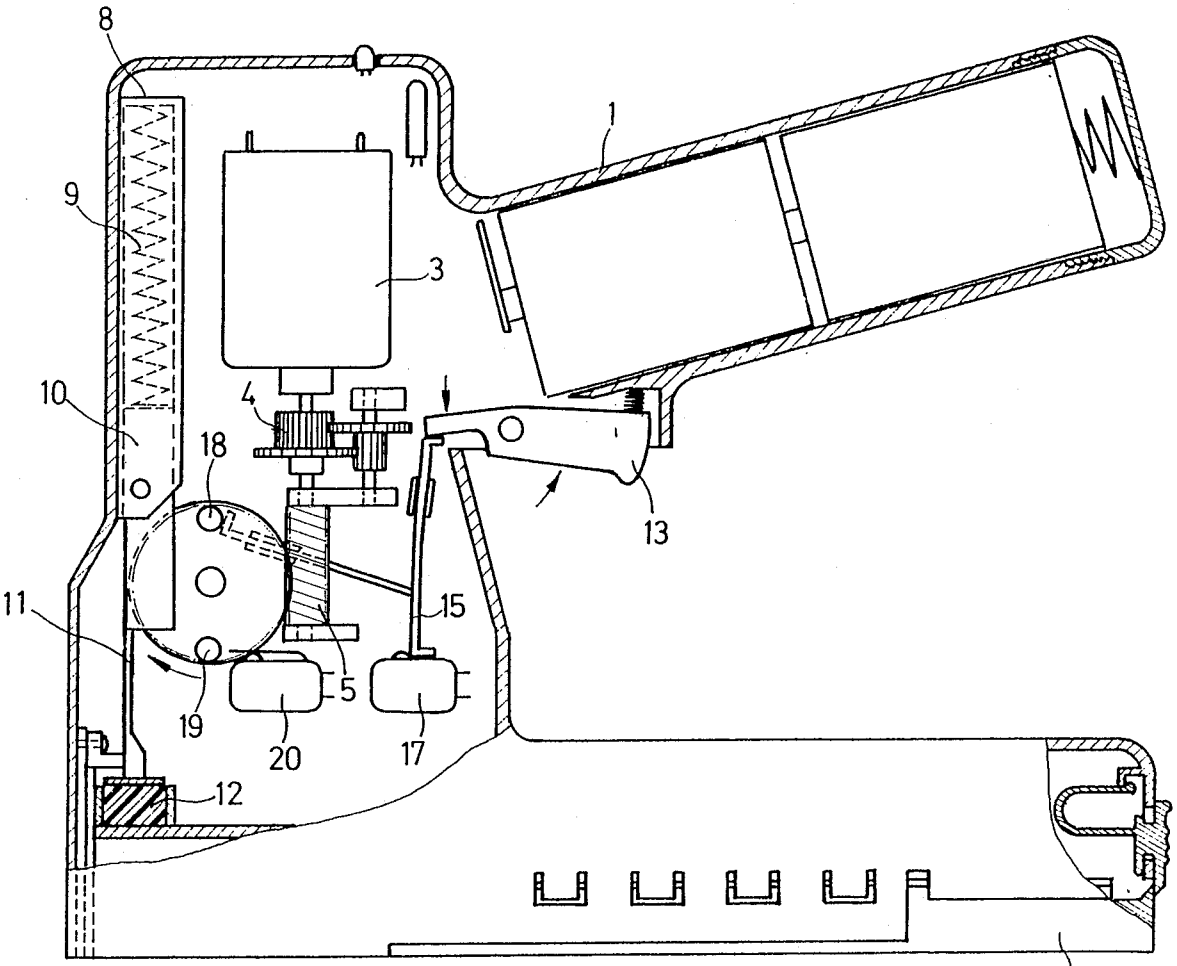
FIG. 4 illustrates a further action of stapling 3 of the preferred embodiment according to the present invention.
Figure 5:
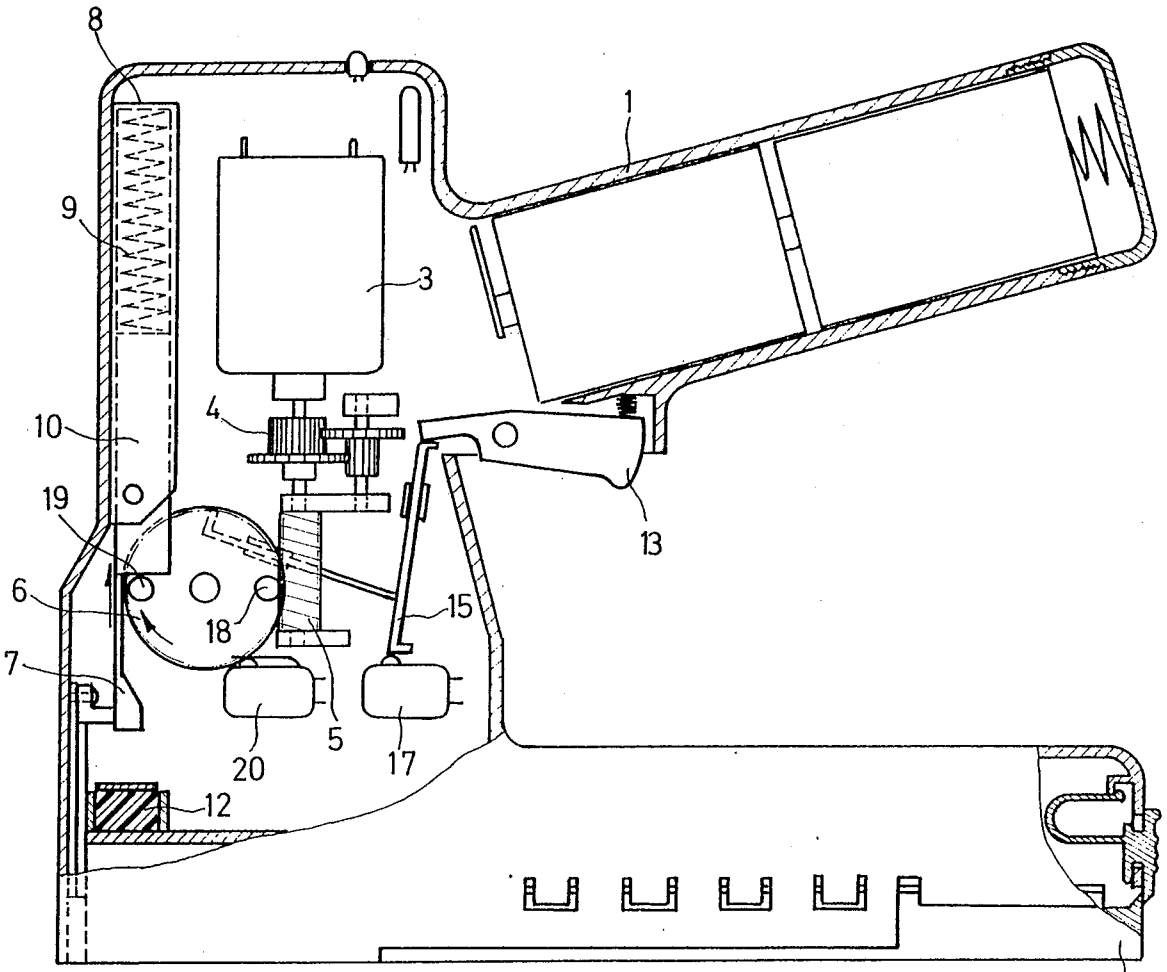
FIG. 5 illustrates a yet further action of stapling 4 of the preferred embodiment according to the present invention.
Figure 6:
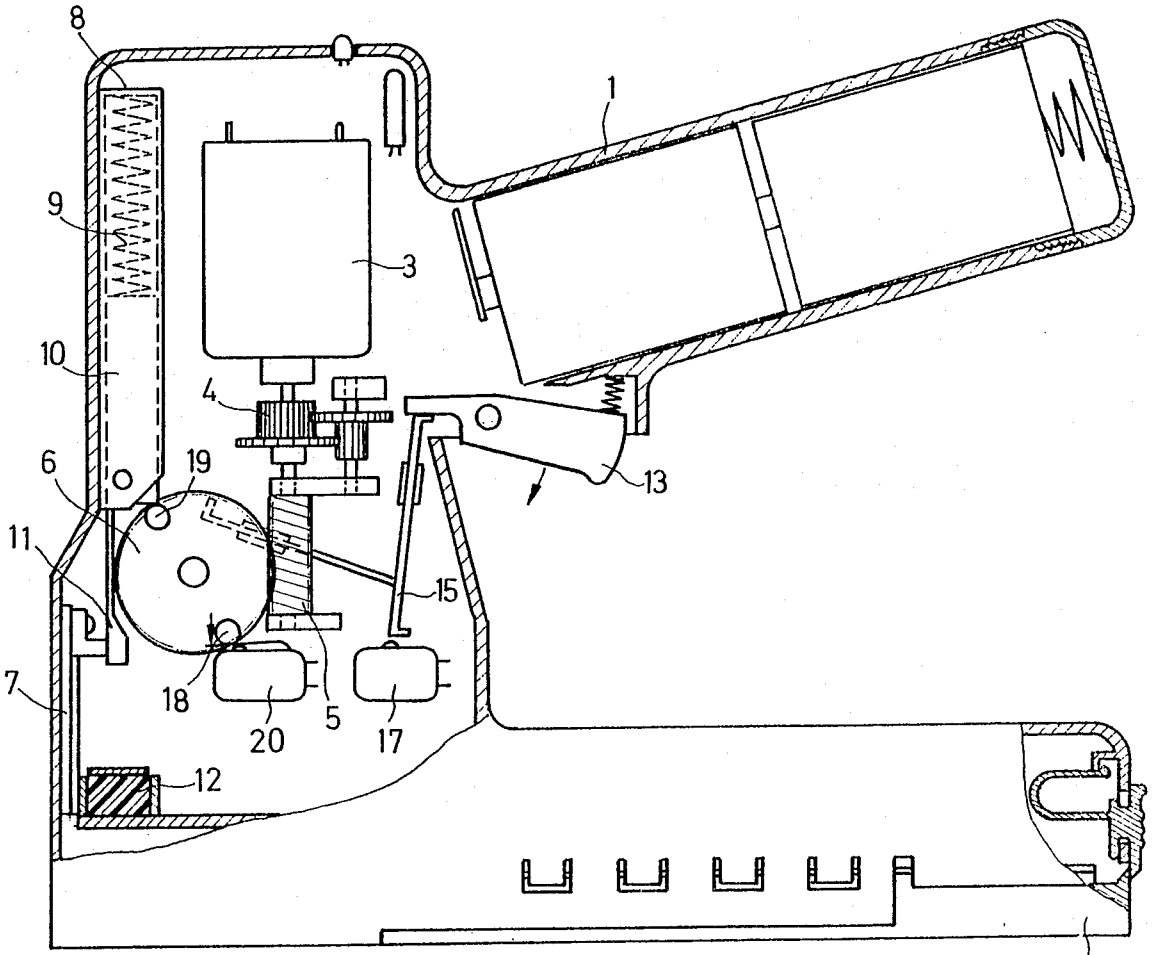
FIG. 6 illustrates the other action of stapling 5 of the preferred embodiment according to the present invention.

Please refer to the illustration of the action of stapling as shown in FIGS. 2–6. When the button 13 is pressed down, the contact rod 15 triggers the position switch 17 to let the circuit ON (as shown in FIG. 2), thus, the motor 3 is turned to drive speed change gear set 4 to rotate so as to turn round the ball screws 5 and simultaneously to drive the gear wheel 6 to rotate. The post of the gear wheel which supports the guide block 10 is drive to leave away from the guide block 10. The guide block 10 is then forced to move outward by the spring 9 to make the percussion block 7 to drive the staples of the staple cartridge. At the same time, the other post of the gear wheel is driven to leave away from the position switch 20 letting the position switch 20 be ON (as shown in FIG. 4). Please also refer to FIG. 7 regarding the circuit diagram. As the gear wheel keeps rotating, the post which releases from the guide block 10 is driven to support the "Y" shaped contact rod 15 at the forked end to push the contact rod 15 letting the contact rod 15 leave away from the position switch 17 so as to short circuit the position switch 17 while the other post is driven to support back the guide block 10 again (as shown in FIG. 5). When the guide block 10 is pushed back to original position, the other post supports the position switch 20 simultaneously to make the position switch 20 be in a short circuit status so as to stop the motor 3. As the motor 3 is stopped (as shown in FIG. 6) the action of stapling is completed and the machine is in a waiting condition for next triggering of the button to start another time of action of nailing.

The power for the DC motor is supplied by the batteries and an alarm device is arranged to give an alarm signal at time of shortage of power. When the power from the batteries 2*a* and 2*b* is insufficient, the motor will consume much more electric current to provide the rating required, therefore, the excessive current loaded turns the thermo breaker 23 on to lighten the alarm lamp and the user will be noted to replace the batteries or to recharge the batteries.

Figure 7:
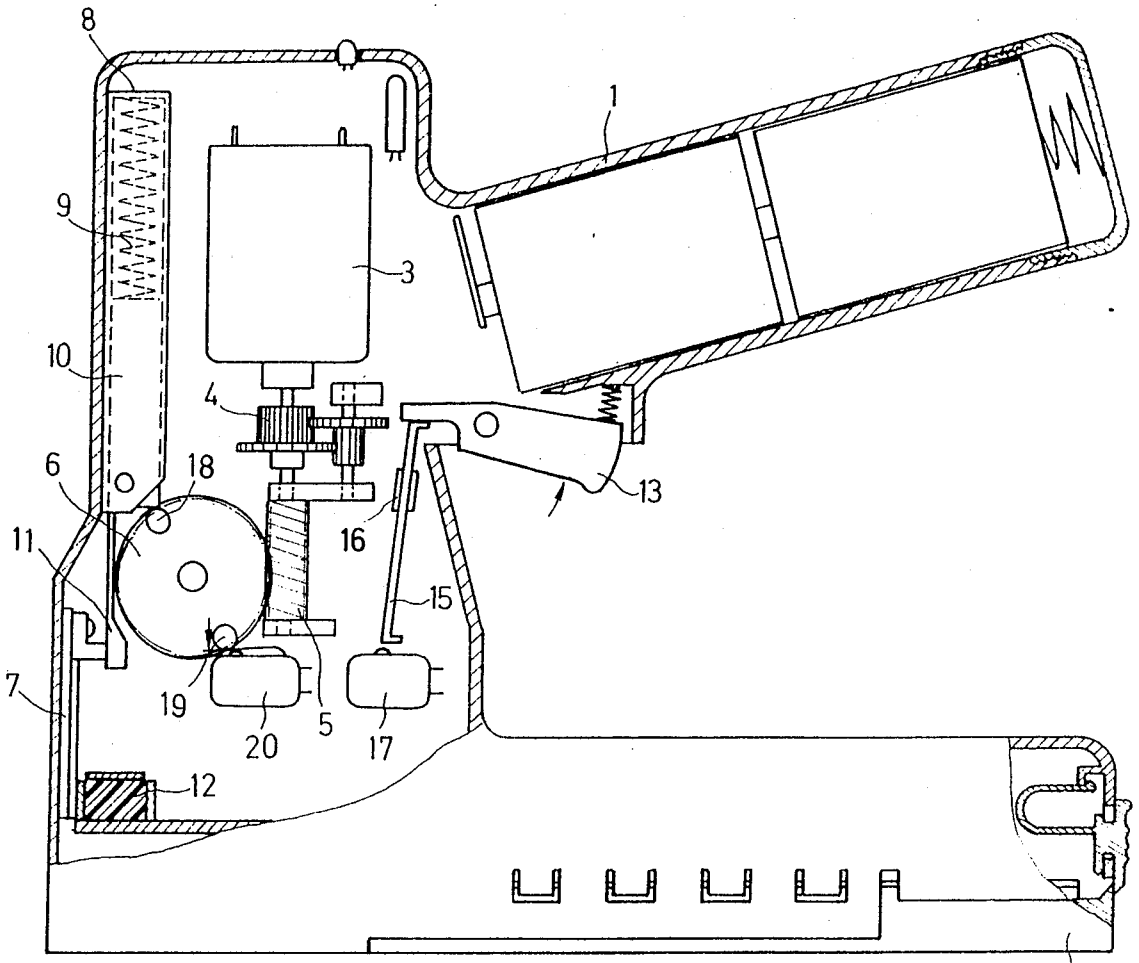
FIG. 7 is a sectional view of another preferred embodiment according to the present invention.

FIG. 7 is a drawing of another preferred embodiment according to the present invention. As shown in the drawing, the link rod 15 is a straight rod directly controlled by the button 13. When the button 13 is pressed down, the link rod 15 triggers the position switch 17 immediately to turn the circuit ON so as to let the motor drive the gear 4 and to let the gear 4 drive the ball screws 5 and the gear wheel 6, and the protruding post of the gear wheel 6 will trigger the position switch 20 without being in contact with the link rod 15.

Figure 8:
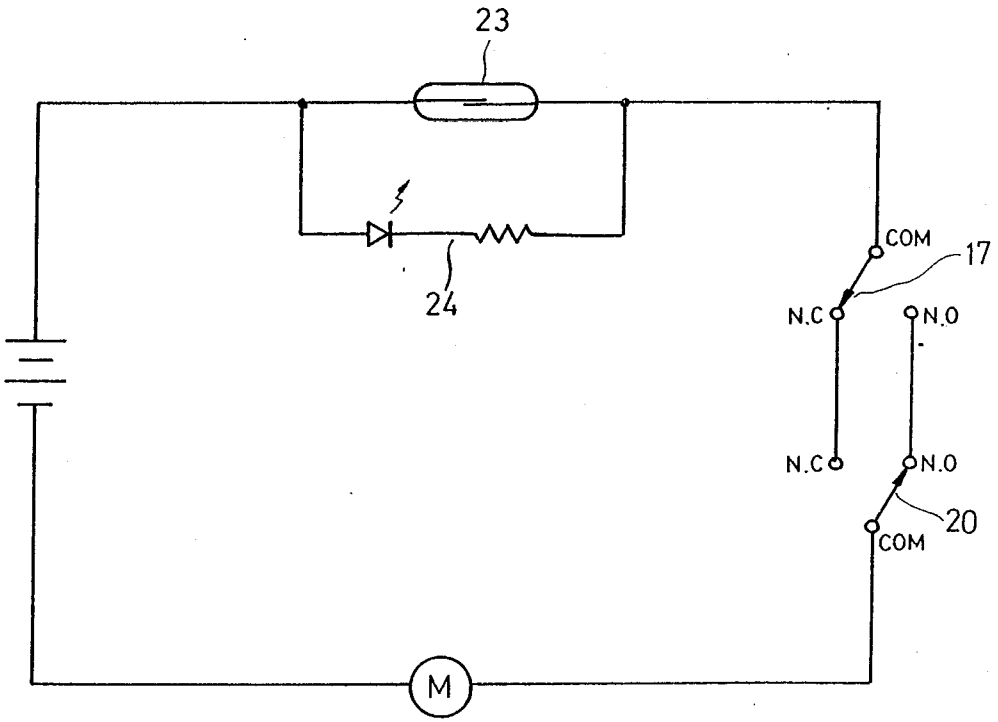
FIG. 8 is a circuit diagram for the present invention.

Please refer to the circuit diagram of the present invention as shown in FIG. 8, wherein the position switch 17 is in N.C. and the position switch 20 is in N.O. When the button 13 is pressed down, the link rod 15 triggers the position switch 17 to switch from N.C. to N.O. to let the circuit ON. Therefore, the motor 3 drives immediately the gear 4, the ball screws 5 and the gear wheel 6 to let the protruding post of the gear wheel leave away from the position switch 20. The position switch 20 is then turned from N.O. to N.C. At the time, the other post of the gear wheel pushed the link rod 15 to release from the position switch 17 to let it be turned from N.O. to N.C. so as to let the circuit ON When the mechanism keeps working, the post of the gear wheel presses on the position switch 20 once again to turn the position switch 20 from N.C. to N.O. so as to make the circuit be in a short circuit condition to complete the action of stapling. The mechanism of the machine is then returned to original position for next action.

The circuit diagram as shown in FIG. 8 is also applicable for the other preferred embodiment previously described. When the button 13 is pressed down, the link rod 15 triggers the position switch 17 to turn it from N.C. to N.O. At the time, the other position switch 20 is on the status of N.O. and all the circuit is turned ON. The motor 3 thus drive the gear 4, the ball screws 5 and the gear wheel 6 to rotate. The protruding post of the gear wheel 6 is accompanied with the gear wheel to turn round and to leave away from the position switch 20 so as to let the position switch 20 skip from N.O. to N.C. As the button 13 is released, the link rod 15 leaves away from the position switch 17 and the position switch 17 is turned from N.O. to N.C. again and the circuit is turned ON again. When the post of the gear wheel contacts the position switch 20 again to let the position switch 20 return to N.O. from N.C. the circle of the action of stapling is thus completed. When the power of the batteries is approximately to used up, the motor 3 should consume more current to drive. The excessive current loaded will make the thermo breaker to work and the LED is lightened to give an alarm signal so as to let the user know the situation of shortage of power and to replace or recharge the batteries.

The button 13 above described can be in a cassette design to let the link rod 15 leave away from the position switch 17 immediately after contact without manual operation on releasing of the button 13 so as to keep the said two position switches 17 and 20 be simultaneously at N.O. status or simultaneously at N.C. status by means of quick switching procedure.

The above description is just for understanding of the spirit of the present invention. Any partly modification or change should be included into the category of the present invention.

I claim:

1. An improved structure of DC motorized stapling machine, composed of

- a battery holder for placement of dry cells or rechargeable batteries,
- a DC motor as the main driving unit of the machine,
- a gear set to reduce the driving speed and to increase the motor torque,
- a ball screws driven by said gear set,
- a gear wheel driven by said ball screws, comprising laterally a plurality of symmetric post,
- a nail driving mechanism comprised of spring, guide block, link rod and percussion block,
- a button mechanism to control the action of nailing,
- one set of position switches for controlling the circuit by means of said button mechanism and the posts of said gear wheel,
- a power shortage alarm circuit to give alarm signal at time of shortage of power.

2. An improved structure of DC motorized stapling machine as claimed in claim 1, wherein said gear wheel comprising laterally a plurality of symmetric posts, one of said posts being pressing the guide block of the nailing mechanism and another post being pressing on a position switch; as the button being pressed down to trigger one position switch, the motor being turned to drive the gear wheel through said gear set and ball screws so as to the posts of the gear wheel release from the position switch and the guide block for the nailing mechanism to start the action of nailing; the mechanism being returned to original position after another posts respectively pressing on the position switch and the guide block.

3. An improved structure of DC motorized stapling machine as claimed in claim 1, wherein said power shortage alarm circuit being comprised of a thermo breaker and DC motor coil to form a series loop; at time the current loaded being too excessive, the thermo breaker being turned ON so as to lighten the LED to give alarm signal.

4. An improved structure of DC motorized stapling machine as claimed in claim 1, wherein said button mechanism being comprised of a button and a button controlled Y shaped link rod, one end of said link rod being in contact with a position switch and the other end being guided on the post of the gear wheel for the control of separating the link rod and the position switch.

5. An improved structure of DC motorized stapling machine as claimed in claim 4, wherein said link rod being a straight rod directly controlled by the button.

6. An improved structure of DC motorized stapling machine as claimed in claim 1, wherein said two position switches in a series connected within the circuit so as to keep the circuit be ON at time both position switches being commonly at N.C. or commonly at N.O.

* * * * *